US007150222B2

(12) United States Patent
Schuttler et al.

(10) Patent No.: US 7,150,222 B2
(45) Date of Patent: Dec. 19, 2006

(54) APPARATUS LONGITUDINALLY STRAPPING A PACKAGE, IN PARTICULAR A STACK OF NEWSPAPERS, MAGAZINES OR THE LIKE

(75) Inventors: Karl Schuttler, Nordheim v.d. Rhön (DE); Jorg Ozga, Bayreuth (DE); Ingrid Schneider-Pfaffenberger, Bindlach (DE)

(73) Assignee: Signode Bernpak GmbH, Dinslaken (DE)

( * ) Notice: Subject to any disclaimer, the term of this patent is extended or adjusted under 35 U.S.C. 154(b) by 0 days.

(21) Appl. No.: 11/006,826

(22) Filed: Dec. 8, 2004

(65) Prior Publication Data

US 2005/0139092 A1 Jun. 30, 2005

(30) Foreign Application Priority Data

Dec. 9, 2003 (DE) ..... 103 57 829

(51) Int. Cl.
*B65B 13/06* (2006.01)

(52) U.S. Cl. ..... 100/26; 100/7; 53/589

(58) Field of Classification Search ..... 100/7, 100/8, 25, 26, 29, 33 PB; 53/589
See application file for complete search history.

(56) References Cited

U.S. PATENT DOCUMENTS

| | | | | |
|---|---|---|---|---|
| 4,711,071 A | | 12/1987 | Kagi | |
| 5,078,057 A | * | 1/1992 | Pearson | 100/25 |
| 5,373,686 A | * | 12/1994 | Lang et al. | 53/589 |
| 5,613,432 A | | 3/1997 | Hoshino | |

FOREIGN PATENT DOCUMENTS

| | | |
|---|---|---|
| DE | 39 09 223 C2 | 10/1990 |
| DE | 41 00 276 | 7/1991 |
| DE | 41 00 276 C2 | 7/1991 |
| DE | 42 30 730 A1 | 3/1994 |
| DE | 196 32 728 C2 | 1/1998 |
| DE | 101 03 409 A1 | 8/2002 |
| EP | 0 545 105 B1 | 6/1993 |
| EP | 1 207 107 A1 | 5/2002 |
| JP | 11 049109 | 2/1999 |

OTHER PUBLICATIONS

Patent Abstracts of Japan, Bd.1999, Nr. 05, May 31, 1999.

* cited by examiner

*Primary Examiner*—Lowell A. Larson
*Assistant Examiner*—Jimmy T Nguyen
(74) *Attorney, Agent, or Firm*—Lowe Hauptman & Berner, LLP

(57) ABSTRACT

A strapping apparatus includes a conveyor for moving the pack to a strapping station containing, a strap guide duct and a tautening and sealing head. The strap guide duct is mounted laterally offset from the direction of conveyance and being curved and twisted toward this conveyance direction in order to subtend a clear inside space for the pack which thereby can be moved unhampered into and out of the strapping station. A guidance element is associated with the strap guide duct to center the strap being released from the strap guide duct on the pack in the strap in the strapping station. The strap guide duct includes corner deflection elements, duct segments which guide the strap always at its outwardly facing side in merely supporting manner, strap twisting segments inserted between the corner deflection elements and guide ducts and imparting a twist to the strap about its longitudinal axis.

12 Claims, 4 Drawing Sheets

APPARATUS LONGITUDINALLY STRAPPING A PACKAGE, IN PARTICULAR A STACK OF NEWSPAPERS, MAGAZINES OR THE LIKE

RELATED APPLICATIONS

The present application is based on, and claims priority from, German Application Number 103 57 829.3, filed Dec. 9, 2003, the disclosure of which is hereby incorporated by reference herein in its entirety.

FIELD OF THE INVENTION

The present invention relates to apparatus longitudinally strapping a pack, in particular a stack of newspapers, magazines or the like using in particular tape-like straps, said apparatus comprising a conveyor moving the pack, with one of its axis aligned with the direction of conveyance, to a strapping station comprising a strap guide duct assuming the geometry of a frame-like, closed-loop strap guide duct used to strap the pack in the direction of conveyance, further a tensioning and closing head, and a feed unit feeding the strap to the strap guide duct which is laterally offset from the direction of conveyance and which curves and twists in such manner that a clearance is subtended for said pack allowing it to move unhampered into and out of the strapping station, a guidance element being associated to the strap guide duct to center the freely moving strapping means coming from the strap guide duct relative to the pack, such apparatus being known for instance from the German patent document DE 41 00 276 C2.

Delicate packs such as stacks of newspapers of which the plies are easily shifted relative to each other require so-called cross-strapping. Cross-strapping may be attained for instance in that, at first, the pack shall be strapped transversely and then is rotated at the same work station about its vertical axis and lastly shall be strapped transversely again. The need to rotate the pack entails in turn integrating an expensive rotation unit into the apparatus while time of operation for dual or several strapping shall be increased.

BACKGROUND OF THE INVENTION

Accordingly it is already known to cross-strap a pack by first strapping it at a first work station transversely to its direction of conveyance and then, without rotating it, to strap it at a second work station in its direction of conveyance, and next, without strapping it. Such apparatus is shown in the above cited German patent document DE 41 00 276 C2.

Longitudinal strapping—also called inline strapping—is problematical relative to cross-strapping because steps must be taken to move the strap guide duct out of the pack's path, i.e. out of the inside contour of this pack. This problem is attacked in the strapping apparatus of DE 41 00 276 C2 by bending and twisting the strap guide duct in a special way as a result of which said duct shall not interfere with the pack when moving through the apparatus. On the other hand such a duct represents manufacturing difficulties because being a spatial structure curving in many directions. Moreover each apparatus size entails a different strap guide duct mold.

Many attempts already have been undertaken and are documented in the state of the art to find other solutions to this problem.

The strapping apparatus disclosed in DE 196 32 728 C2 offers a strapping frame which shall be pivoted as needed about a horizontal axis situated underneath the work surface into the strapping position when the pack to be strapped assumes its position. The consequent mechanical implementation is comparatively costly. Similar considerations apply to the longitudinal strapping apparatus of DE 101 03 409 A1.

DE 42 30 730 A1 shows a strapping apparatus comprising a strap guide duct fitted with a rectilinearly displaceable frame element which together with an affixed frame element constitutes such a twisted segment. In this disclosure again at least some portions of the strap guide duct are twisted.

EP 0 545 105 B1 discloses apparatus longitudinally strapping a pack wherein the strap guide duct comprises two segments running parallel to the plane of strapping and on opposite sides of the strapping plane along the diagonally mutually opposite zones of the pack and at such a distance from the strapping plane that they shall not hamper the pack's motion, said segments being connected to each other by means of other segments crossing the strapping plane. Such a tape duct too is comparatively complex.

Another apparatus, also disclosed in EP 0 545 105 B1, provides that the strap guide duct substantially run in a plane obliquely intersecting the strapping plane in an intersection line perpendicular to the direction of conveyance, and in that the binding head be pivotably supported about an axis situated in said line of intersection and is driven in a way that when the tape is inserted it assumes an angular position wherein its longitudinal center plane coincides with the plane of the strap guide duct, and in that said binding head shall pivot into the strapping plane when the tape is tensioned. Such apparatus is complex and costly in particular as regards its control and furthermore it incurs high mechanical stresses due to the binding head being driven in pivotable manner, and it is susceptible to malfunctions.

EP 1 207 107 A1 discloses a strapping apparatus comprising a strap guide used to form a strap loop in a waiting position regardless of the position of body being strapped, a loop displacing element being used to drive the strap loop formed by the guide from a waiting position in the apparatus' bench plane into a stacking position around a body to be strapped. In other words, a strap loop is prepared in a horizontal position and, following the positioning of the pack to be strapped, it is pivoted upward into a position from which said loop may strap the pack. This design requires driven gripper segments gripping the strap loop and erecting it along curved arms.

The above described apparatus operating on very different principles are comparatively complex/expensive relative to the initially cited German patent document DE 41 00 276 C2, in particular those requiring additional drives for the sealing unit, the strap guide duct or the erection of the loop.

Accordingly it is the objective of the present invention to create, on the basis of DE 41 00 276 C2, apparatus to longitudinally strap packs without requiring special drive mechanism requirements and allowing comparatively simple manufacture of the strap frame.

SUMMARY OF THE INVENTION

This problem is solved by at least one embodiment of the present invention in that the strap guide duct is composed of corner deflection elements and of further duct segments merely supporting and guiding the strap at each of its outwardly facing sides, further of strap twisting segments inserted between the corner deflection elements and that the duct segments to twist the strap about its longitudinal axis.

As regards the strap twisting segments, advantageously said strap shall be twisted only by 40–60°, preferably only about 45°, about its longitudinal axis. As a result, compared to the corner deflection elements and the further duct segments, the strap twisting segments may be kept short. This design is based on the insight of the present invention that it is enough to impart a mere initial twist of about 45° to the strap shot at high speed into the strap guide duct even when, in the most typical and required instance, the strap will have to be twisted by a total angle of 90°. It was found that such an initial twist or torsion impulse suffices to let the strap continue to rotate about its longitudinal axis on its further path beyond the strap twisting segment until after a total twisting angle of 90°, it can rest appropriately by its main, outwardly facing surface on the associated guide path and then is able to easily move along to further follow the path curvatures of said guide.

In one embodiment mode of the present invention, the strap twisting segments each consist of a slotted duct which is longitudinally open toward the pack and which comprises a strap intake slot and a strap exit slot that is rotated by about 45° relative to the former slot, a strap sliding path with mutually facing guide and twisting faces being present between said two slots.

In a further embodiment of the present invention, the corner deflection elements each may subtend a 90° strap deflection and moreover they may each subtend a duct which is longitudinally and unilaterally open toward the pack, such a duct allowing retracting the strap under return tension to tauten the pack. Advantageously, all corner deflection elements of the strap guide duct are identical with each other. These corner deflection elements may made of molded plastic.

Therefore—contrary to the case of DE 41 00 276 C2—the core of the present invention, wherein the strap guide duct itself is bent many times and is twisted in screw-like manner, substantially consists of the strap guide duct being made up of a few duct segments which are easily manufactured and are elongated or in the sense of strap guidance are parallel to the large strap surface and of relatively small twisting segments, namely the strap twisting segments. This feature offers advantages both in manufacture and in assembly. Furthermore the invention allows in this way to assemble a strap guide duct in modular manner and thereby it may be assembled in comparatively simple manner using fewer standard parts to assemble different strap guide ducts and to match them to different strapping apparatus.

BRIEF DESCRIPTION OF THE DRAWINGS

The present invention is elucidated below in an illustrative embodiment relating to the appended drawings.

DETAILED DESCRIPTION OF PREFERRED EMBODIMENTS

Figure 1:
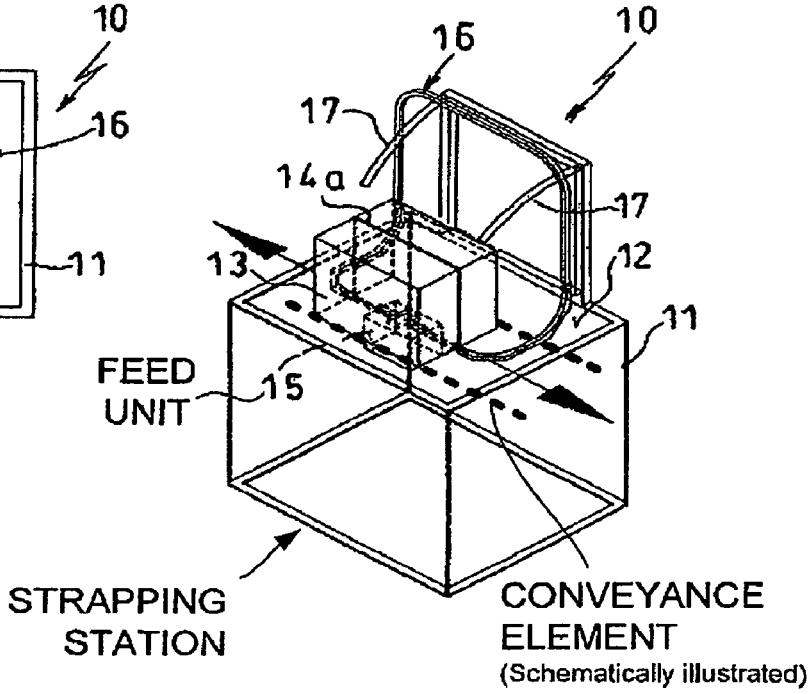
FIG. 1 is a schematic perspective of a strapping apparatus of the present invention.

FIG. 1 shows apparatus denoted overall by 10 to longitudinally strap a pack, in particular a stack of newspapers, magazines or the like. This apparatus or strapping station, comprises a housing 11 fitted with a bench 12 on which rests a pack 13 to be strapped with a longitudinal strapping 14*a*.

Besides an omitted supply of strap, a feed unit or device 15 is located underneath the bench 12 and is used to shoot the strap 14 (FIG. 5) into a strap guide duct 16 and also to retract in a tautening manner the strap 14 and to lock the mutually overlapping strap ends in the region of the apparatus. The strap used is the conventional thermoplastic tape of shallow-rectangular cross-section.

Figure 2:
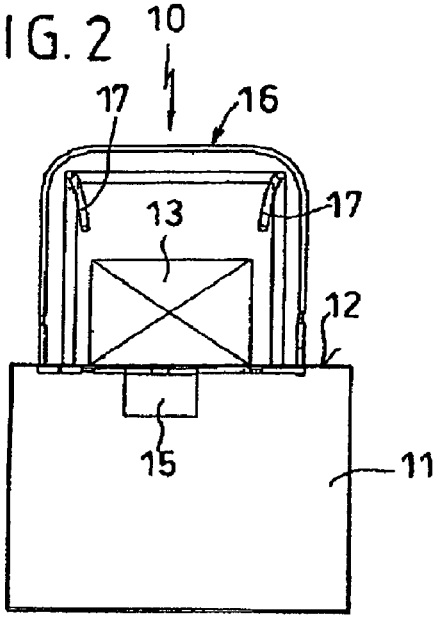
FIG. 2 is a schematic front view of the apparatus of FIG. 1.
Figure 3:
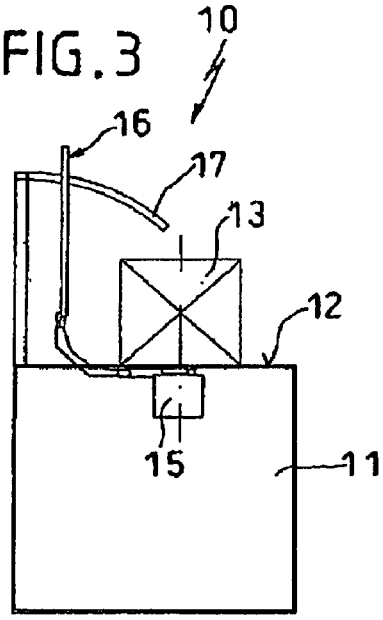
FIG. 3 is a schematic sideview of FIG. 1.
Figure 4:
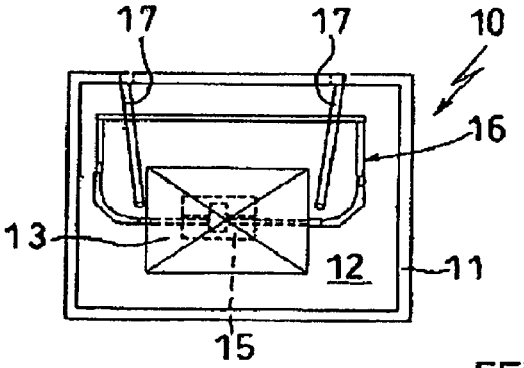
FIG. 4 is a schematic topview of the apparatus shown in FIG. 1.

The strap guide duct denoted as a whole by 16 and as shown in particular in FIGS. 1, 3 and 4 is mounted partly below or in the plane of the bench 12, foremost however in a manner that shall not impair the conveyance of the pack 13 outside its clearance profile, in particular to the side of its direction of conveyance indicated by arrows in FIG. 1.

When the strap 14 is shot into the strap guide duct 16 in the direction of one of the two arrows shown in FIG. 1, this strap must pass through arcs or bends in different directions in order that its leading end shall reach again the locking unit 15 and lastly it must be held in place in the strap guide duct 16 in such a way that after a retracting force is applied to it and by being imparted a direction of deflection 17 in a plane situated in a conveyance plane of the pack 13, it can be tautened preferably centrally onto the pack 13.

The strap guide duct which is basic to the present invention is free of any movable parts and is designed with an open slot facing the pack 13, as a result of which the tape when imparted a retraction can be automatically pulled out of the strap guide frame 16.

Figure 5:
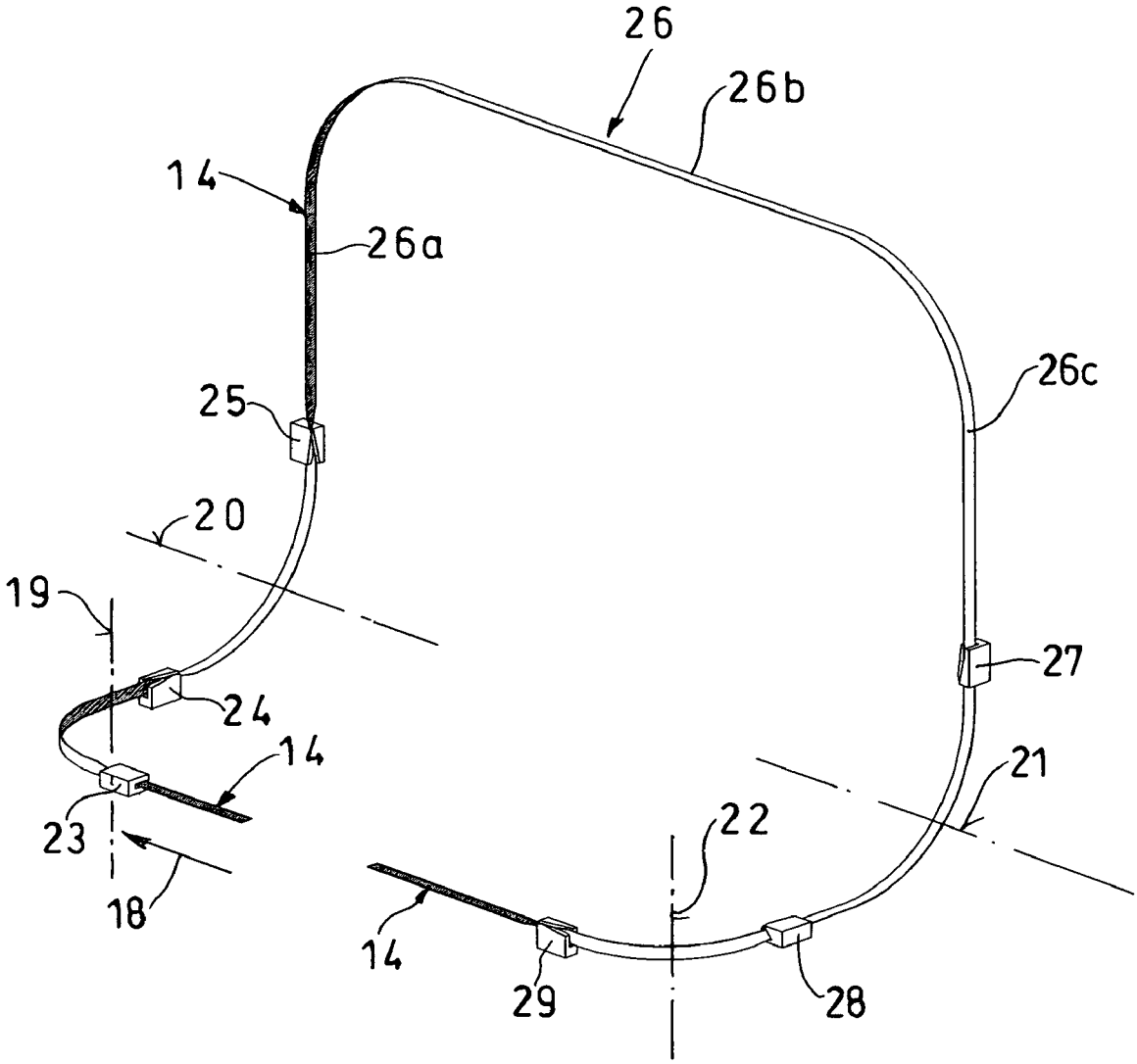
FIG. 5 shows the geometry and perspective of a strap guide duct of the strapping apparatus.

FIG. 5 illustrates the path the strap 14, which is a plastic tape of shallow cross-section, must cover to form a strap loop. Be it assumed that the strap 14 is shot by an insertion system not (shown in FIG. 5) in the direction of the arrow 18 underneath the plane of the bench 12 into the strap guide duct. Initially the strap 14 must be guided while being deflected by about 90°, namely about the vertical axis 19 indicated in schematic manner in FIG. 5. Next the tape must be deflected again by about 90° about a horizontal axis 20. Then the strap 14 moves upward through a vertical segment 26*a* and when at the top of the strap loop through a horizontal segment 26*b*, and, after a 90° deflection of this strap 14, through a further vertical segment 26*c* downward. Thereupon the strap 14 must be guided again about a further horizontal axis 21 and once more about a vertical axis Kagi in order that it arrives, in the same direction in which it left the insertion system, again into said system's region, in particular into the locking unit.

A strap in the form of shallow-cross-sectional tape may be easily bent about an axis situated both transversely to its longitudinal direction and parallel to the tape's plane. In this respect a tape is compliant to bending. On the other hand it may not be bent transversely by a significant angle, and in this direction it is extremely stiff against bending.

The present invention palliates this condition in that the tape shall be twisted at the required sites about its longitudinal direction or an axis in order that subsequent to this twisting it may be bent back into its direction of bending bias. This feature is especially significant because the tape is shot freely into the tape strapping duct rather than for instance being pulled by mechanical grippers.

As regards the embodiment mode of FIG. 5, the strap 14 is twisted clockwise by a first strap twisting segment 23, whereby the strap 14, after leaving the strap twisting segment 23, is able to follow the curve about the vertical axis 19. A second strap twisting segment 24 then follows, which twists the strap 14 back into its initial condition, that is the twisting direction now is opposite that imparted by the strap twisting segment 23 to said strap 14. As a result the strap 14 is able to follow the curve defined by the horizontal axis of curvature 20. Thereupon the strap 14 is twisted again by 90° by a third strap twisting segment 25 in order that it can follow the strap duct segment (band path 26) composed of the two vertical segments 26*a*, 26*c* and the horizontal top segment 26*b*.

Thereupon three further strap twisting segments 27, 28 and 29 follow in the direction of advance of the strap 14 and each imparts to said strap a twist such the arcs about the horizontal axis of curvature 21 and the vertical axis of curvature 22 may be negotiated. The last strap twisting segment 29 guides the strap 14 at last out of the vertical direction of the last arc about the axis 22 back into a horizontal position wherein it may be guided toward the strap sealing unit.

Figure 6:
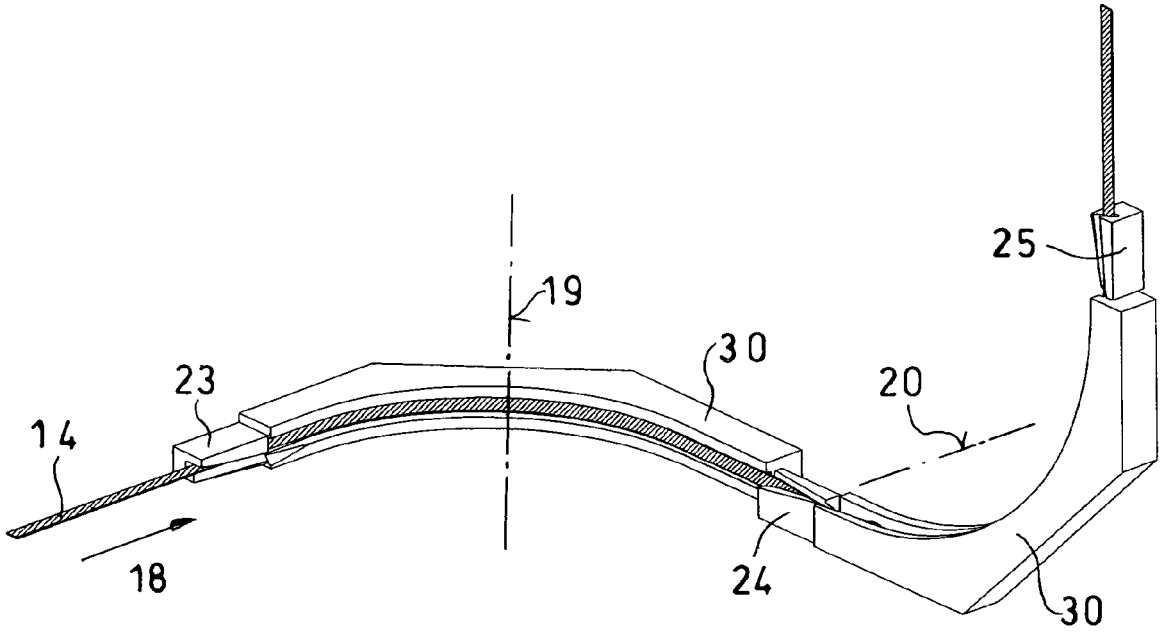
FIG. 6 is a cutaway of the strap guide duct in the region of a strap deflection element showing two corner deflection elements and three strap twisting segments.

FIG. 6 shows two arcuate, in particular quarter-circle guides for the strap 14, it being assumed that the strap 14 is moved in the direction of the arrow 18, The first strap twisting segment 23 shown in FIG. 6 guides the strap 14 twisted about its longitudinal direction into a first corner deflection element 30 from where said strap 14 exits twisted clockwise and then enters a second strap twisting segment 24. This strap twisting segment 24 twists the strap 14 back against the twisting direction that the strap twisting segment 23 has imparted to it and transfers it to a second corner deflection element 30 wherein the strap 14 moves along an arc around the horizontal axis of curvature 20. After the strap 14 exits from the second corner deflection element 30, it is guided toward a third strap twisting segment 25 which then shall twist it again about its longitudinal axis.

Figure 7:
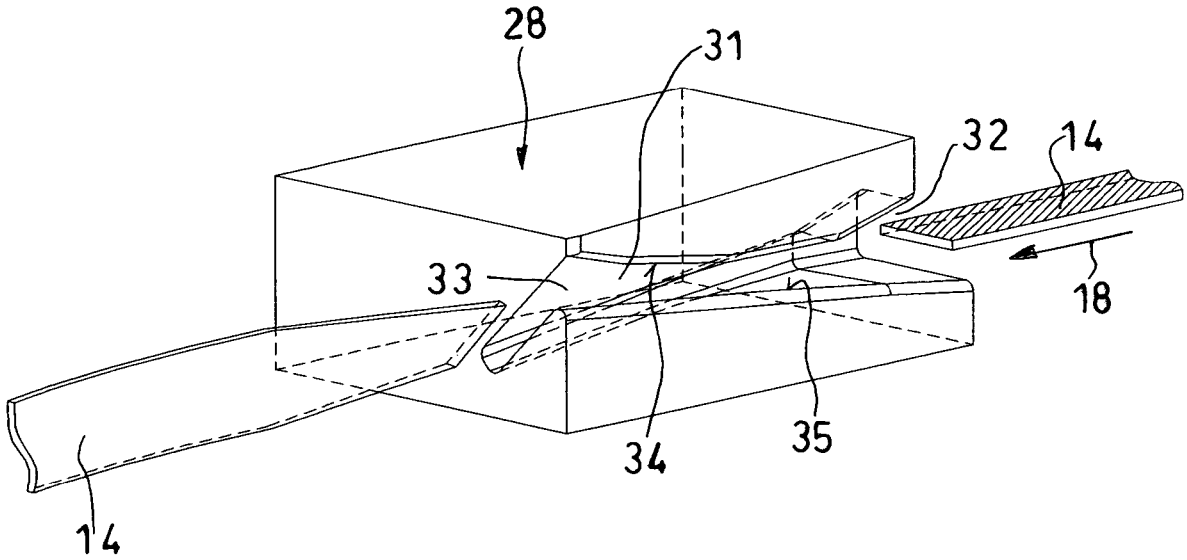
FIG. 7 shows a strap twisting segment in detail.

FIG. 7 schematically shows a strap twisting segment 28 receiving the strap in the direction of arrow 18.

The strap twisting segment 28 comprises a slot 31 that is, as indicated, open at the edge, from which said strap may be retracted by a return tension when it shall be tautened about a pack.

Furthermore the strap twisting segment 28 comprises a strap intake slot 32 and a strap exit slot 33. The strap slot 32 tapers like a funnel for optimized guidance of leading end of the strap 14 and constitutes on the inside mutually opposite slide surfaces 34 and 35 for the broad sides of the strap 14.

In this embodiment mode the twist angle from the strap intake slot 32 to the strap exit slot 33 is only approximately 45° even though the total angle to rotate the strap 14 each time about its longitudinal axis as a rule is 90°. To this extent therefore a strap twisting segment imparts to the tape only an initial torsion. The remaining this angle is implemented automatically by the tape in the region of the guide surfaces which, adjoining a strap twisting segment, which are kept in readiness by the strap guide track of a corner deflection element 30 or by another segment of the strap guide duct. One must emphatically point out that these guide paths do not require being prepared or shaped in a special manner, and this feature explains the special simplicity of the apparatus of the present invention.

The invention claimed is:

1. An apparatus for longitudinally strapping a pack, using a tape-like strap, said apparatus having a conveyance element for moving the pack along an axis running in a direction of conveyance to a strapping position in a strapping station and a feed unit for feeding strap, the apparatus comprising:

a frame-like strap guide duct configured to receive strap from the feed unit and comprising a closed loop configured to strap the pack in a direction parallel to the direction of conveyance, the strap guide duct having a portion laterally offset from the conveyance element and configured such that a clearance is produced with respect to the pack so that the pack may move into and out of the strapping station without interference with the strap guide duct, a steering element being associated with the strap guide duct to center the strap released from the strap guide duct in the strapping station on the pack, and wherein:

the strap guide duct comprises:

corner deflection elements, duct segments which guide the strap, the duct segments comprising two essentially straight, untwisted vertically oriented segments and an essentially straight untwisted horizontally oriented segment located between the two essentially straight, untwisted vertically oriented segments, and strap twisting segments which are disposed between selected corner deflection elements and duct segments and which twist the strap about its longitudinal axis.

2. Apparatus as claimed in claim 1, wherein the strap twisting segments each twist the strap by approximately 40–60° about its longitudinal axis.

3. Apparatus as claimed in claim 2, wherein the strap twisting segments each twist the strap by approximately 45° about its longitudinal axis.

4. Apparatus as claimed in claim 1, wherein the strap twisting segments are short compared with the corner deflection elements and the duct segments.

5. Apparatus as claimed in claim 1, wherein the strap twisting segments each subtend a longitudinally open slot duct unilaterally facing the pack and comprising a strap intake slot and a strap exit slot which is twisted thereto by about 45° relative to said intake slot, a strap twist slide path defined between mutually opposite strap guide surfaces being subtended between said intake and exit slots.

6. Apparatus as claimed in claim 1, wherein the corner deflection elements each subtend a 90° deflection of the strap.

7. Apparatus as claimed in claim 1, wherein the corner deflection elements each subtend a longitudinally open duct unilaterally toward the pack from which the strap can be retracted when tensioned backward in order to tauten the pack.

8. Apparatus as claimed in claim 6, wherein all corner deflection elements of the strap guide duct are identical with each other.

9. An apparatus for longitudinally strapping a pack, comprising:

a strap guide duct configured to receive strap from a feed unit, the strap guide duct comprising a closed loop configured to strap the pack in a direction parallel to a direction of conveyance, the strap guide duct comprising:

corner deflection elements, duct segments disposed with the corner deflection elements to guide the tape which passes through the corner deflection elements, the duct segments comprise two essentially straight, untwisted vertically oriented segments and an essentially straight untwisted horizontally oriented segment located between the two essentially straight, untwisted vertically oriented segments, and strap twisting segments which are disposed between selected corner deflection elements and duct segments and which each twist the strap about its longitudinal axis.

10. Apparatus as claimed in claim 9, wherein the two essentially straight, untwisted vertically oriented segments and the essentially straight untwisted horizontally oriented segment located between the two essentially straight, untwisted vertically oriented segments are interconnected by corner deflection elements and wherein strap twisting segments are absent.

11. Apparatus as claimed in claim 9, further comprising a steering arrangement which guides the tape after it leaves the two essentially straight, untwisted vertically oriented segments and the essentially straight untwisted horizontally oriented segment located between the two essentially straight, untwisted vertically oriented segments, and deflects the tape toward a predetermined position on the stack.

12. Apparatus as claimed in claim 11, wherein the steering arrangement comprise two curved rod-like members which are supported to extend under the essentially straight untwisted horizontally oriented segment and which curve toward on another.

* * * * *